US008944586B2

(12) United States Patent
Chung et al.

(10) Patent No.: US 8,944,586 B2
(45) Date of Patent: Feb. 3, 2015

(54) PRINTER BED AND INK JET PRINTER USING THE SAME

(75) Inventors: Kwang Choon Chung, Yongin (KR); Hae Sung Jung, Ansan (KR); Ki Yong Kim, Gwangju (KR); Kyung Soo Kim, Siheung (KR); Sung Chul Jeon, Seoul (KR); Chung Il Kim, Suwon (KR)

(73) Assignee: Inktec Co., Ltd., Ansan (KR)

( * ) Notice: Subject to any disclaimer, the term of this patent is extended or adjusted under 35 U.S.C. 154(b) by 325 days.

(21) Appl. No.: 13/123,618

(22) PCT Filed: Oct. 9, 2009

(86) PCT No.: PCT/KR2009/005812

§ 371 (c)(1),
(2), (4) Date: Apr. 11, 2011

(87) PCT Pub. No.: WO2010/041911

PCT Pub. Date: Apr. 15, 2010

(65) Prior Publication Data

US 2011/0193921 A1 Aug. 11, 2011

(30) Foreign Application Priority Data

Oct. 10, 2008 (KR) ..... 10-2008-0099877

(51) Int. Cl.

| | |
|---|---|
| ***B41J 2/01*** | (2006.01) |
| ***B41J 11/00*** | (2006.01) |
| ***B41J 3/28*** | (2006.01) |
| ***B41J 11/06*** | (2006.01) |

(52) U.S. Cl.

CPC ..... *B41J 11/0085* (2013.01); *B41J 3/28* (2013.01); *B41J 11/06* (2013.01)

USPC ..... 347/104; 347/16; 347/101

(58) Field of Classification Search

None

See application file for complete search history.

(56) References Cited

U.S. PATENT DOCUMENTS

| | | | | |
|---|---|---|---|---|
| 5,746,914 | A * | 5/1998 | Hanna et al. | 210/266 |
| 6,328,440 | B1 * | 12/2001 | Medin et al. | 347/102 |
| 6,357,869 | B1 * | 3/2002 | Rasmussen et al. | 347/102 |
| 6,628,423 | B1 * | 9/2003 | Sasaki | 358/1.7 |
| 6,672,720 | B2 * | 1/2004 | Smith | 347/104 |

(Continued)

FOREIGN PATENT DOCUMENTS

| | | | | |
|---|---|---|---|---|
| KR | 10-0137812 | * | 7/1996 | H05K 13/00 |
| KR | 10-0137812 | B1 | 7/1996 | |

(Continued)

*Primary Examiner* — Manish S Shah
*Assistant Examiner* — Jeremy Delozier
(74) *Attorney, Agent, or Firm* — Birch, Stewart, Kolasch & Birch, LLP

(57) ABSTRACT

An ink jet printer bed in which a printing object placed on a bed is stably fixed by means of air suction and is printed, is disclosed, which comprises a plurality of upper plates having a plurality of air suction ports on their front surfaces; an intermediate plate which is formed of a guide space of which intermediate portion is open via its upper lower sides, the intermediate plate being assembled to a lower side of the upper plate; a lower plate which is assembled to a lower side of the intermediate portion and is formed of at least one air passage; a connection part which is assembled to each air passage of the lower plate and is connected with a suction pump; and a sensor which detects an air pressure in the interior of the bed and transmits a result of the detection to a controller which controls the operation of the suction pump, so the air pressure of the interior of the bed by the suction pump can be adjusted.

8 Claims, 9 Drawing Sheets

(56) References Cited

U.S. PATENT DOCUMENTS

| | | | | |
|---|---|---|---|---|
| 6,682,238 | B2 * | 1/2004 | Yraceburu et al. | 400/635 |
| 6,957,887 | B2 * | 10/2005 | Bruhn | 347/104 |
| 7,097,374 | B2 * | 8/2006 | Sugiura et al. | 400/656 |
| 7,168,800 | B2 * | 1/2007 | Katayama | 347/86 |
| 7,431,278 | B2 * | 10/2008 | Hiraki et al. | 271/3.14 |
| 7,530,687 | B2 * | 5/2009 | Ishii et al. | 347/104 |
| 7,722,183 | B2 * | 5/2010 | Tanabe | 347/104 |
| 7,794,032 | B2 * | 9/2010 | Kimura | 347/7 |
| 7,819,519 | B2 * | 10/2010 | Eve | 347/104 |
| 2001/0000055 | A1 | 3/2001 | Hevenor et al. | |

FOREIGN PATENT DOCUMENTS

| | | | | |
|---|---|---|---|---|
| KR | 10-2002-0006700 | A * | 1/2002 | B41F 1/32 |
| KR | 10-2004-0085972 | A * | 10/2004 | B41J 25/315 |

* cited by examiner

PRINTER BED AND INK JET PRINTER USING THE SAME

This is the U.S. National Phase Application under 35 U.S.C. 371 of International Application PCT/KR09/05812, filed on Oct. 9, 2009, which claims the priority of Korean Application No. 10-2008-0099877, filed Oct. 10, 2008, the entire content of both Applications are hereby incorporated by reference.

TECHNICAL FIELD

The present invention relates to an inkjet printer, and in particular to a printer bed and an inkjet printer using the same which make it possible to automatically control a vacuum suction force by reliably checking a vacuum suction state applied to the interior of a bed depending on the kinds, weight and dimension of a printing object placed on a printer bed, so it is possible to print a printing object with best quality under a stable environment that a printing object is stably fixed at a bed surface.

BACKGROUND ART

An ink jet printer prints a printing object provided in a form of a flexible paper sheet, a film or something in a roll.

When using the ink jet printer, a printing object is inserted into an ink jet printer, and an ink jet printer starts printing a printing object as a printer head horizontally reciprocates in a direction perpendicular to a transferring direction of a printing object when a transfer roller transfers a printing object.

The ink jet technology applied to such ink jet printer is widely applied to a home/office small size printer as well as an industrial big size printer. In recent years, an industrial ink jet printer using a UV ink is widely used in industries. The industrial ink jet printer is basically designed to print a flexible printing object such as paper sheets, woven materials, etc. as well as a rigid and large-sized printing object such as a wooden plate, a metallic plate, a glass plate, etc.

A representative of such industrial ink jet printers is disclosed in Korean patent registration number 10-0434825 entitled "Flat bed type ink jet printer".

The above flat type ink jet printer is designed to print a printing object which is rigid, heavy or thick. The flat type ink jet printer comprises a bed with an air passage in its interior and an air suction part formed at its upper surface, a fixing support part integrally fixed at the bed, thus supporting the bed, an air suction part connected with the air passage for discharging or sucking the air, a head bar engaged to the bed for thereby helping the head horizontally in a horizontal direction, and a transfer part for helping the head bar to move horizontally in a direction vertical to the bed.

The conventional ink jet printer is basically directed to printing with the aid of an operation of a printer head while a printing object such as a paper sheet or film is being transferred by means of the transfer roller, but since the flat type ink jet printer is directed to printing a printing object such as a wooden plate, a metallic plate, a glass plate, etc. which is heavy or big, the printer head prints while moving along the whole portions of the bed in a state that a printing object is placed on the bed.

The conventional flat type ink jet printer uses a vacuum suction force so as to stably fix a printing object on a bed.

A plurality of air suction ports are formed at an upper surface of the bed and the interior of the bed has a certain space for fixedly sucking a printing object with the aid of a suction force. The conventional flat type ink jet printer is formed in one space structure without having a support pole for supporting the bed while efficiently discharging the air from the air suction ports to the air suction part.

The conventional ink jet printer has the following problems.

In the conventional flat type ink jet printer, since a vacuum suction force should be uniformly applied to the entire surfaces of a bed on which a printing object is placed, when a printing object is small in size, an external air might be inputted via some air suction ports on which the printing object does not cover.

So, a larger vacuum suction force is needed so as to fixedly suck a printing object, which leads to increasing power consumption. An over load might be needed to a vacuum suction device, which results in a problem in the system. A lot of noises occur due to a high performance vacuum suction operation.

Since a larger space is provided in the interior of the bed, the conventional flat type ink jet printer is formed without a space in which any poles are not provided so as to suck an inner air in the entire portions of the bed.

In the above construction, when a heavier printing object is placed on the bed, the upper surface of the bed might be bent or broken, so it might be needed to replace the entire parts of the system.

In order to improve the above problems, there is provided a certain means for preventing the bending of the upper surface by adjusting the thickness of an upper surface of the bed, but since the bed is generally made of a little expensive material for obtaining a desired flatness of an upper surface, the manufacture of the conventional flat type ink jet printer costs a lot, which results in a higher sale price, so a user must have pay more money which gives the user a financial problem.

The conventional bed is not equipped with any detection means or control means for checking a vacuum suction force depending on the weight, thickness and dimension of a printing object, the same suction forces are always applied irrespective of the weight and dimension of a printing object placed on the bed.

When a relatively thin and light printing object is placed on the bed, since there is not any measure for checking the above state, a higher vacuum suction force is applied. In this case, a certain dent might be formed on the surface of a printing object due to a strong suction force by means of an air suction part or the surface might be bent, which prevents a proper printing. When a printing is performed without noticing the above problem, the printing does not occur at the problematic surface, so all the finished printing objects might be destroyed, causing a lot of financial losses.

In the conventional art, a worker is needed to adjust a vacuum suction force in a manual method by adjusting a valve depending on the thickness, weight, material or something of a printing object, which leads to very bad operation efficiency of the ink jet printer, causing a lot of economical loses.

DISCLOSURE OF INVENTION

Accordingly, it is an object of the present invention to provide a bed of an ink jet printer which make it possible to automatically control a vacuum suction force by reliably checking a vacuum suction state applied to the interior of a bed depending on the kinds, weight and dimension of an printing object placed on a printer bed, so it is possible to print a printing object with best quality under a stable environment that a printing object is stably fixed at a bed surface.

It is another object of the present invention to provide an ink jet printer which has a stable vacuum suction force and a reliability that a surface of a bed does not bend even when a heavy printing object is placed on the same.

It is further object of the present invention to provide an ink jet printer bed which makes it possible to efficiently and economically manage an ink jet printer in such a manner that a vacuum suction force is applied to a minimum area that a printing object is placed on a bed, and a printing is performed in a state that a printing object is stably fixed.

To achieve the above objects, there is provided an ink jet printer bed in which a printing object placed on a bed is stably fixed by means of air suction and is printed, comprises a plurality of upper plates having a plurality of air suction ports on their front surfaces; an intermediate plate which is formed of a guide space of which intermediate portion is open via its upper lower sides, the intermediate plate being assembled to a lower side of the upper plate; a lower plate which is assembled to a lower side of the intermediate portion and is formed of at least one air passage; a connection part which is assembled to each air passage of the lower plate and is connected with a suction pump; and a sensor which detects an air pressure in the interior of the bed and transmits a result of the detection to a controller which controls the operation of the suction pump, so the air pressure of the interior of the bed by the suction pump can be adjusted.

In the present invention, it is possible to print a printing object with best quality in a state that a printing object is stably fixed without damaging a printing object by checking a vacuum suction state applied to an internal space of a bed with the aid of a sensor for thereby automatically controlling a vacuum suction force even when the kinds, weights and dimensions of a printing object to be placed on a bed are different from each other.

According to another embodiment of the present invention, at least two guide spaces of an intermediate plate are provided, with each air passage and each connection part being connected to their corresponding guide spaces, respectively.

In the present invention, a vacuum suction force is applied to minimum guide space needed for a printing object to be place on a bed, and a vacuum suction force is not applied to the remaining guide spaces in which a printing object is not placed, according to which it is possible to print a printing object under the optimum stable printing environment.

The ink jet printer according to the present invention has advantages in the facts that power consumption can be minimized since a vacuum suction device is not unnecessarily operated, and noises do not occur, thus maintaining an ink jet printer more efficiently and economically.

According to another embodiment of the present invention, the bed of an ink jet printer according to the present invention has an enhanced reliability since a support frame is assembled to an outer side of an intermediate plate, and an upper frame and a lower frame are assembled to an upper side and a lower side of the support frame, respectively.

According to further another embodiment of the present invention, a guide passage is vertically and repeatedly formed in a guide space of an intermediate plate in a continuous form.

The guide passage is formed in a honeycomb shape, and in another example of the same, the guide passage might be formed in a rectangular shape which is repeatedly and continuously formed.

Each guide passage has a connection part which is connected with another one.

In the present invention, a reliable construction can be obtained, by which the surface of a bed is not bent even when a heavy printing object is placed on the bed while maintaining a uniform vacuum suction force over the entire portions of the bed for a stable and optimum printing environment with the aid of an intermediate plate having a plurality of guide passages in the interior of the bed.

According to another embodiment of the present invention, a lower side of each guide passage of an intermediate plate has a certain space from an upper surface of the lower plate.

The above space functions as a connection part for allowing air to pass, with which it is possible to implement a connection part of another type so as to obtain a more uniform vacuum suction force.

Advantageous Effects

In the present invention, it is possible to automatically control a vacuum suction force by checking a vacuum suction state applied to the interior of a bed depending on the kinds, weight and dimension of a printing object placed on a bed of a printer.

So, a high quality printing can be obtained under the optimum printing environment with the aid of a stably fixed printing object irrespective of the kinds of a printing object placed on the surface of a bed.

The present invention provides an enhanced reliability by which the surface of a bed is not bent since the entire bottom surfaces of a bed can be stably supported by means of a partition formed between the guide passages even when a heavy printing object is placed, while maintaining a stable and uniform vacuum suction force under the best printing environment with the aid of a plurality of guide passages of an intermediate plate.

The printing work of an ink jet printer can be efficiently and economically performed in such a manner that a printing is performed by stably fixing a printing object by applying a vacuum suction force with respect to the minimum area needed for a printing object to be placed on a bed.

BRIEF DESCRIPTION OF THE DRAWINGS

The present invention will become better understood with reference to the accompanying drawings which are given only by way of illustration and thus are not limitative of the present invention, wherein.

BRIEF DESCRIPTIONS OF REFERENCE NUMERALS OF MAJOR ELEMENTS OF THE DRAWINGS

| | |
|---|---|
| 10: bed | 20: upper plate |
| 21: air suction port | 22, 42: engaging hole |
| 30: intermediate plate | 21: guide space |
| 32: support frame | 40: lower plate |
| 41: air passage | 50: suction pump |
| 51: connection hose | 60: connection part |
| 70: sensor | 80, 90: guide passage |
| 81, 91: connection part | D: distance |
| P: Printing object | 100: ink jet printer |

MODES FOR CARRYING OUT THE INVENTION

The preferred embodiments of the present invention will be described with reference to the accompanying drawings.

Figure 1:
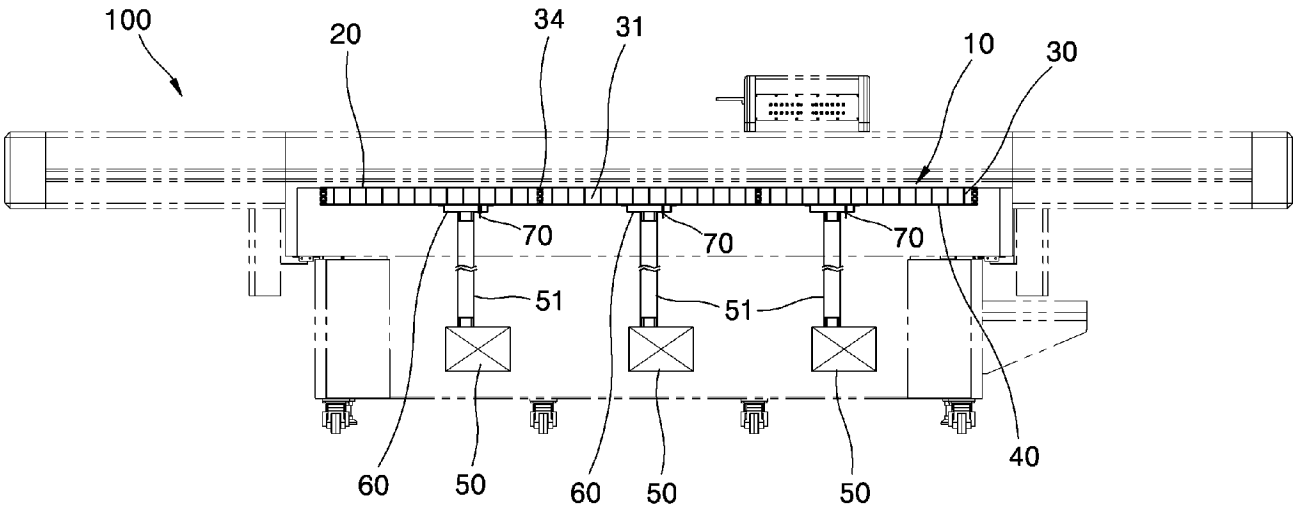
FIG. 1 is a front view illustrating an ink jet printer with a bed according to the present invention.
Figure 2:
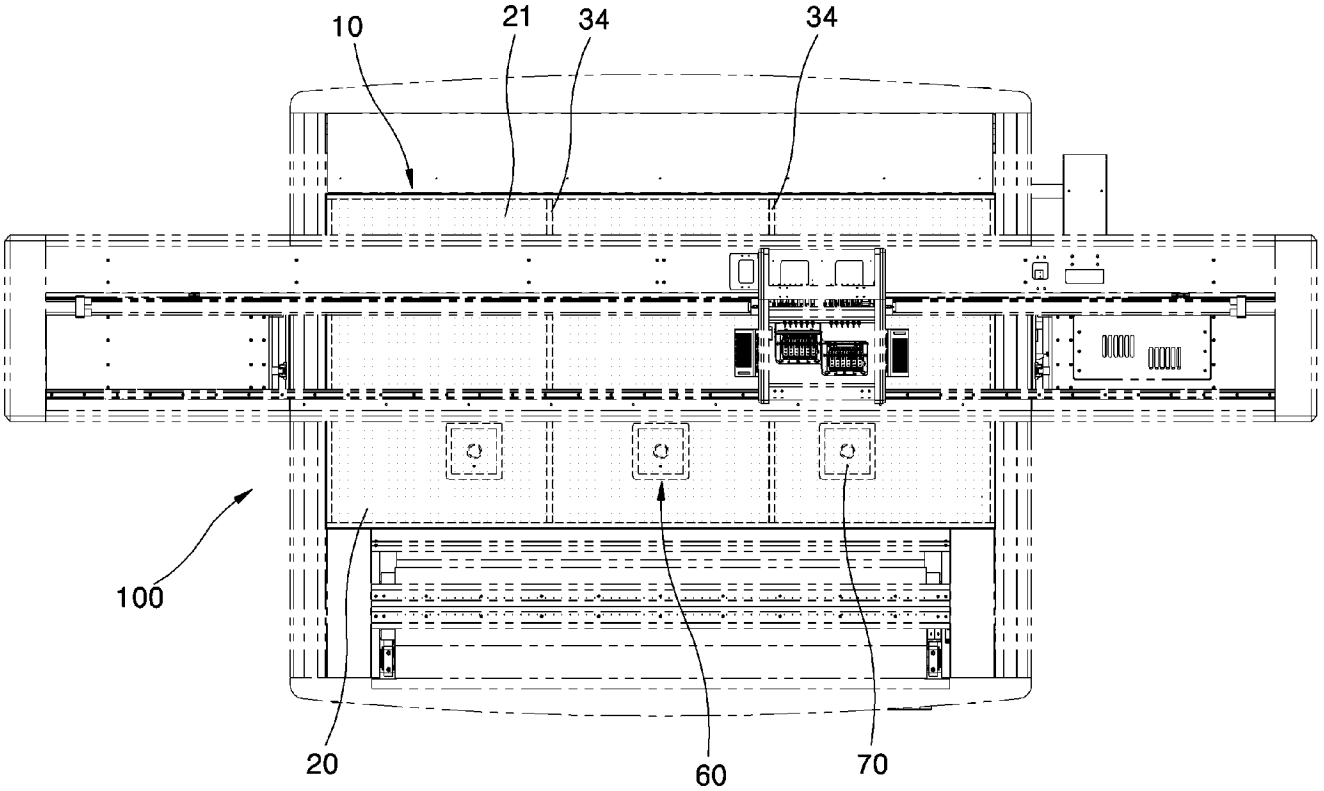
FIG. 2 is a plane view of FIG. 1 illustrating an ink jet printer with a bed according to the present invention.
Figure 3:
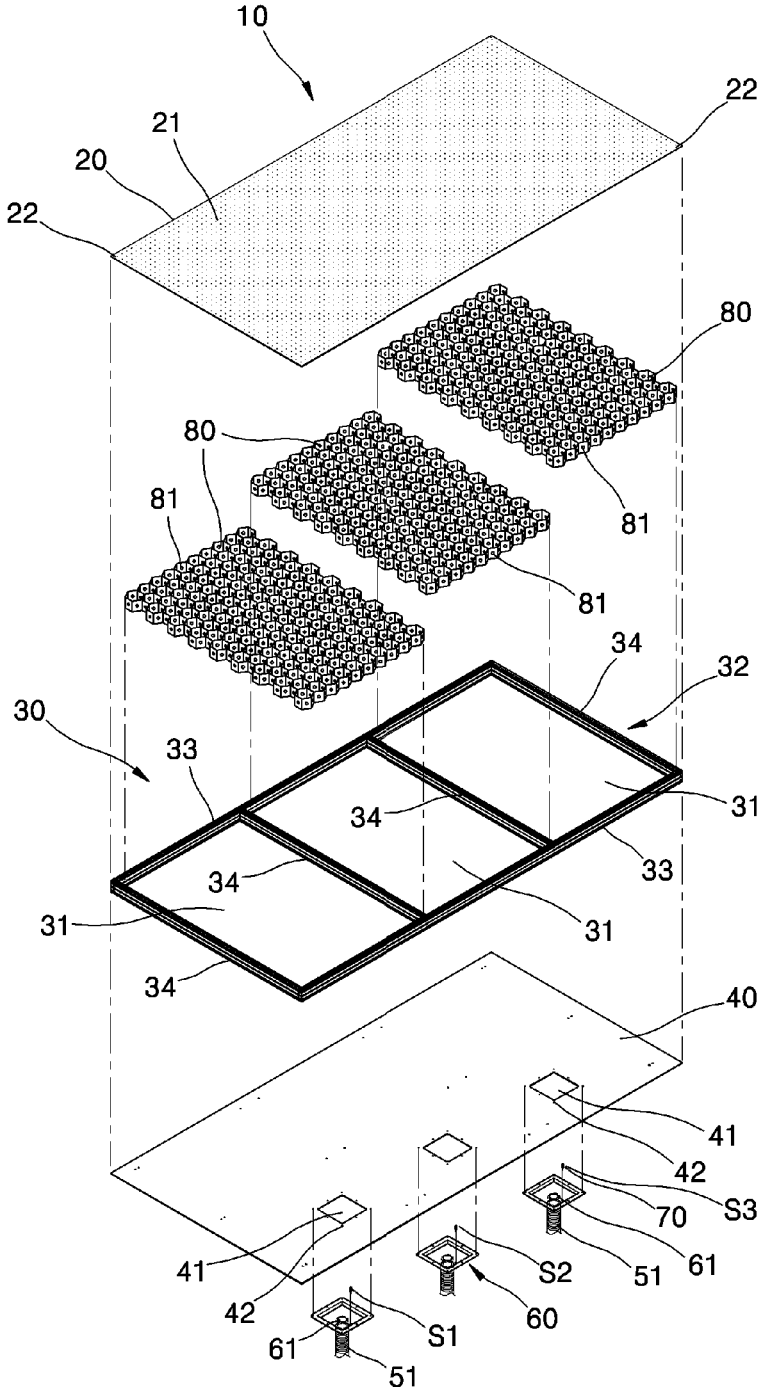
FIG. 3 is a disassembled perspective view illustrating an inner construction of a bed of an ink jet printer according to an embodiment of the present invention.
Figure 4:
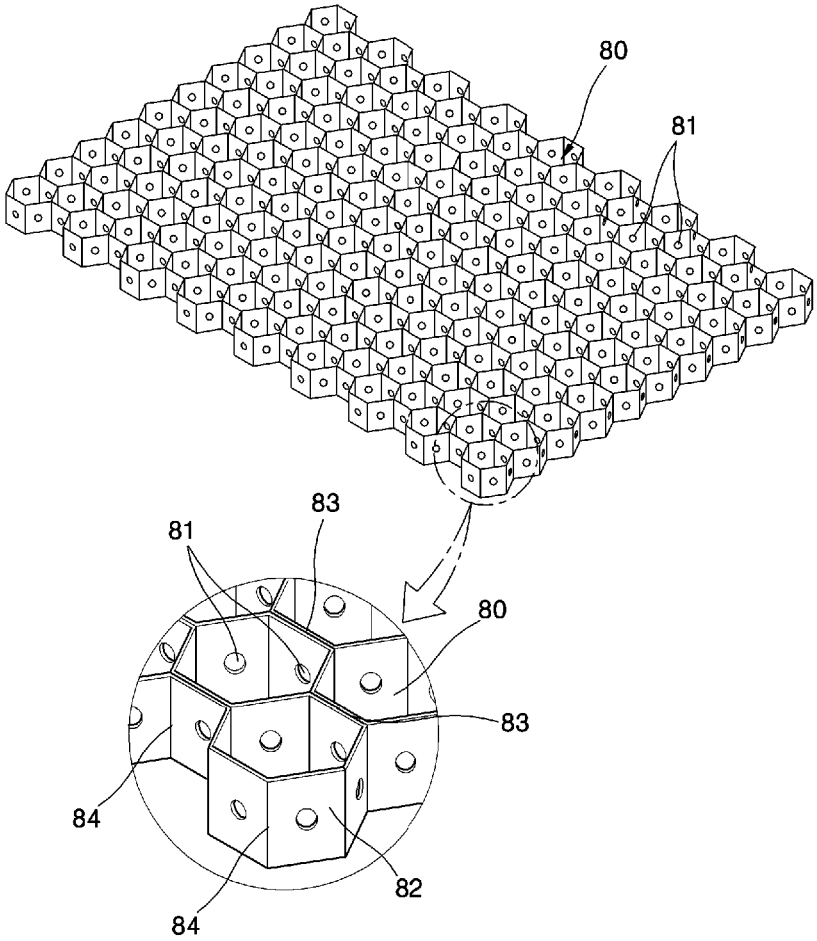
FIG. 4 is an enlarged perspective view of a major part of FIG. 3 illustrating in details the construction of a honeycomb guide passage of an intermediate plate according to an embodiment of the present invention.

FIG. 1 is a front view illustrating an ink jet printer with a bed according to the present invention, and FIG. 2 is a plane view of FIG. 1 illustrating an ink jet printer with a bed according to the present invention, and FIG. 3 is a disassembled perspective view illustrating an inner construction of a bed of an ink jet printer according to an embodiment of the present invention, and FIG. 4 is an enlarged perspective view of a major part of FIG. 3 illustrating in details the construction of a honeycomb guide passage of an intermediate plate according to an embodiment of the present invention.

As shown therein, the bed 10 of the ink jet printer 100 according to the present invention is basically directed to closely fix a printing object P, to be printed, with the aid of air suction, thus printing a printing object.

The printing object used in the present invention might be a fixable one selected from the group comprising a paper sheet, a woven sheet, etc. and a rigid one selected from the group comprising a wooden plate, a metallic plate, a glass plate, etc., the printing object also including all kinds of materials such as a Printed Circuit Board (PCB) or others which can be printed.

The ink jet printer according to the present invention comprises an upper plate 20, an intermediate plate 30 and a lower plate 40.

It is preferred that the upper plate 20 has a certain thickness and is made of a strong synthetic resin material or a metallic material in a rectangular shape.

A plurality of air suction ports 21 are formed on the entire surfaces of the upper plate 20, each air suction port 21 having a certain small diameter determined depending on a space area of the interior of the bed 10, with the interval between the neighboring air suction ports 21 being determined based on a printing area of the bed 10. The air suction ports 21 are continuously formed in a square shape.

The four corners of the upper plate 20 have a plurality of engaging holes 22 at regular intervals, thus being assembled with the intermediate plate 30.

The intermediate plate 30 has a guide space 31 the intermediate portion of which is open via its upper and lower sides and has a certain height so as to obtain a certain vacuum suction space.

As shown in FIG. 3, according to another embodiment of the present invention, the support frame 32 is assembled to an outer side of the intermediate plate 30, and the upper plate 20 and the lower plate 40 are assembled to the upper side and lower side of the support frame 32, respectively, along with an enhanced reliability which withstands the weight of a printing object P applied to the entire portions of the bed 10.

The support frame 32 is formed in a profile shape and comprises a horizontal support part 33 corresponding to a horizontal length of the upper plate 20, and a vertical support part 34 corresponding to a vertical length of the upper plate 20.

The horizontal support part 33 and the vertical support part 34 are assembled to form a rectangular shape, thus making a support frame 32, and the support frame 32 is screw-connected to a lower edge portion of the upper plate 20, so the outer structure of the upper plate 20 is finished, thus forming a guide space 31 in the inner side of the support frame 32.

The lower plate 40 is assembled to a lower side of the intermediate plate 30 in the same size as the upper plate 20 and has a plurality of air passages 41 at its one side.

The air passage 41 each may be formed in a circular shape or as shown in FIG. 3 in a rectangular shape, with each air passage 41 being formed of a plurality of engaging holes 42 at its outer side.

A connection part 60 is provided at the air passage 41 of the lower plate 40 for a connection with a suction pump 50 provided at a lower side of the ink jet printer 100 in order to make a vacuum state by sucking the air in the interior of the guide space 31, with the connection part 60 being screw-connected to the engaging hole 42.

The connection part 60 is formed in a rectangular shape corresponding to the shape of the air passage 41, with a connection boss 61 being protruded from the center of the connection part 60 for a connection with a flexible connection hose 51 connected with the suction pump 50. The connection hose 51 is inserted into the connection boss 61 and is sealingly clamped for preventing the leakage of air.

A sensor 70 is provided at an inner end portion of the connection part 60 for detecting the pressure of air. The signal from the sensor 70 is transferred to a controller (not shown), and the controller analyzes the input signal, thus controlling the output of the suction pump 50 in order to maintain the pressure of the air of the interior of the bed at a certain level. It is preferred that the output control of the suction pump 50 is obtained by changing a frequency Hz of the voltage supplied to the suction pump 50.

With the above constructive features, it is possible to automatically control the output of the suction pump 50 by detecting the vacuum suction state, namely, the pressure of the air applied to the inner space of the bed 10 by using the sensor 70 irrespective of the kinds, weight or dimension of the printing object P placed on the bed of the ink jet printer 100.

The advantages of the present invention help prevent the printing object from being damaged by means of the vacuum suction force which is provided at a constant level like the conventional art. The stable vacuum suction force determined depending on the weight and dimension of the printing object P helps closely contact the printing object on the bed 10, which leads to a printing with best quality.

According to the present invention, the bed 10 of the ink jet printer 100 has a function of automatically controlling a proper vacuum suction force as compared to the conventional art in which the vacuum suction force is manually controlling based on a valve opening and closing operation depending on the state of the printing object placed on the bed, so the vacuum suction force can be automatically adjusted in a programmed method depending on the kinds of printing objects.

The sensor 70 provided in the interior of the connection part 60 helps adjust the output of the suction pump 50 to maintain a proper level of the vacuum suction force by detecting a state that the vacuum suction force increases in the interior of the guide space because the air suction port 21 is closed by means of the printing object P or other things, which leads to preventing the damages of the device and performing a printing work of the ink jet printer with enhanced efficiency and economical advantages.

Figure 8:
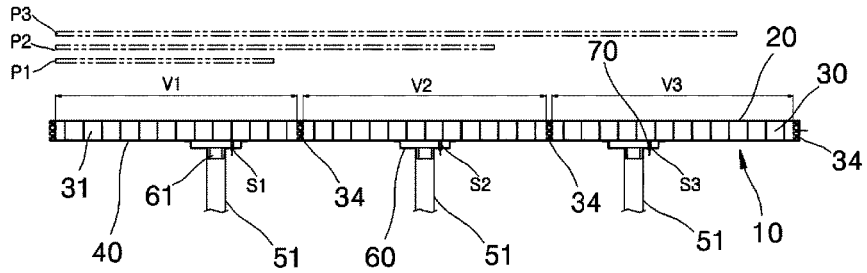

As shown in FIGS. 1 through 3, according to another embodiment of the present invention, the guide space 31 of the intermediate plate 30 is divided into multiple parts. As shown in FIG. 8, the entire area of the bed 10 is divided into three parts, thus forming first through third guide spaces V1, V2 and V3. The sensor 70 may be formed of first through third sensors S1, S2 and S3.

The air passage 41 and the connection part 60 installed at each air passage 41 are connected with the first through third guide spaces V1, V2 and V3, respectively, and the suction pump 50 is connected with the connection boss 61 of each connection part 60 via the connection hose 51.

What the suction pump 50 is connected with connection part 60 has been described, but it can be configured to adjust the vacuum suction force applied to a plurality of the guide spaces in accordance with an opening and closing control of the valve by using one suction pump incase of small or medium size printers.

Figure 7:
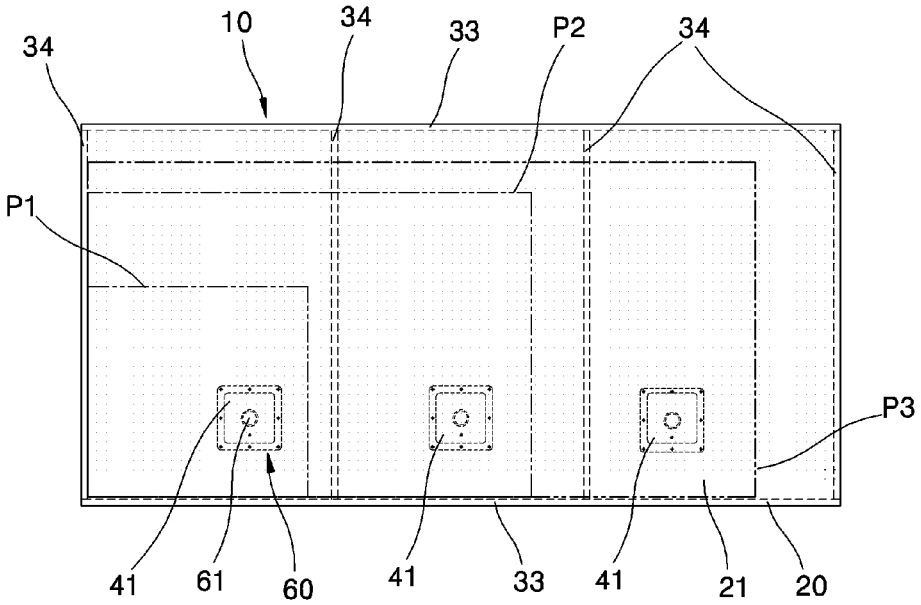
FIGS. 7 and 8 are front cross sectional views illustrating the construction of a bed according to the present invention.

As shown in FIGS. 7 and 8, a vacuum suction force is applied only to minimum guide space 31 needed for the printing object P to be placed on the bed, whereas the vacuum suction force is not applied to the remaining guide spaces 31 in which the printing object P is not placed, so that it is possible to print under a stable environment that the printing object P is stably placed on the bed 10 with minimum vacuum suction force.

For example, when a small size printing object P1 is placed only on the first guide space V1, the first sensor detects the vacuum suction force, thus driving the suction pump with a proper pressure.

The system may be programmed like since the suction pressure is not needed to be applied to the second guide space V2 and the third guide space V3, the second sensor S2 and the third sensor S3 detect the force, and driving of the suction pump remains standby, and the driving may be stopped after a certain time passes by.

When a medium sized printing object P2 is placed on the bed, the vacuum suction force is applied to both the first guide space V1 and the second guide space V2, and when a large sized printing object P3 is placed on the bed, the vacuum suction force is applied to all the first guide space V1, the second guide space V2 and the third guide space V3, respectively, so the first through third sensors S1, S2 and S3 detect the force, and the vacuum suction force applied to the guide spaces V1, V2 and V3 are compared with one another, whereby the output level of each suction pump 50 can be selected and controlled so that the printing object can be stably and uniformly sucked and fixed depending on its weight and dimension.

With the aid of the above features of the present invention, it does not need to operate the vacuum suction device or other devices, according to which it is possible to reduce power consumption and noises. The bed of the ink jet printer according to the present invention is very efficient in operation, and the ink jet printer can be used very economically.

According to another embodiment of the present invention, a guide passage 80 is continuously and repeatedly formed at the guide space 31 of the intermediate plate 30 in a vertical direction.

The guide passage 80 may be formed in various shapes. It is preferred that the guide passage is formed in a honeycomb shape as shown in FIGS. 3 and 4.

The connection part 81 is formed at each guide passage 80, the connection parts being connected with one another.

Figure 9:
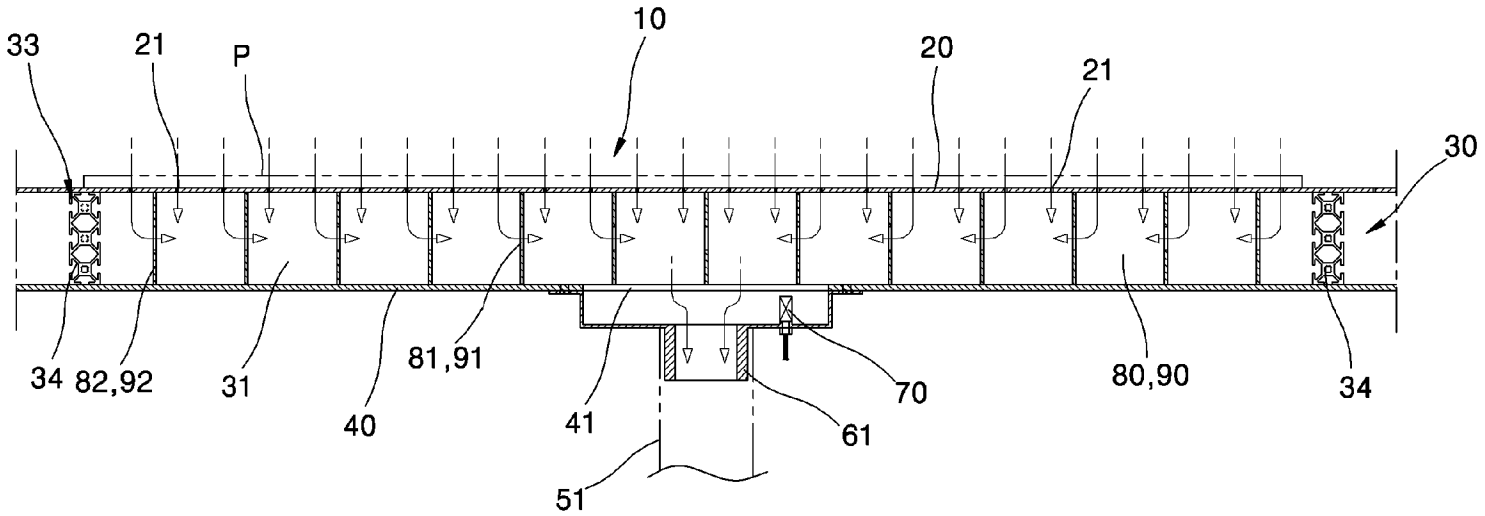
FIG. 9 is an enlarged cross sectional view of a major part for describing the construction of a vacuum adsorption construction of a bed of an ink jet printer according to the present invention.

As shown in FIG. 9, the connection parts 81 are formed at the partition 82 belonging to the honeycomb guide passage 80, so air flows between the guide passages 80, so the vacuum suction force is uniformly distributed to each guide passage.

According to the construction of the guide passage 80, the air suction ports 21 are formed at the honeycomb guide passages 80 in proper numbers.

When vacuum suction force is applied to the guide space 31 of the bed 10, the same air pressure is applied to the honeycomb guide passage depending on its area, and air communicates with each guide passage 80 via the connection part 81, so the suction force of the air suction ports 21 are uniform, according to which the printing object P placed on the upper plate 20 is stably sucked and fixed, not being damaged.

The method for manufacturing the honeycomb guide passage 80 will be described in brief. Namely, as it is not shown in the drawings, the honeycomb guide passage 80 is made in such a manner that a paper sheet or a synthetic resin plate having a certain thickness and a width are cut in a longitudinal direction and are stood upright and are overlapped with each other in a continuous form.

The opposite hexagonal contact surfaces 83 are bonded with each other alternately, and a folding line 84 is formed at its center portion for folding, and a connection part is formed by punching holes at an adhering surface 83 and its both side surfaces in overlapped states.

In the above state, both ends are pulled, by which the folding lines 84 of both sides are vent inwardly and outwardly with respect to the adhering surface 83, according to which a hexagonal honeycomb shaped guide passage 80 is formed. The connection part 81 is formed at a side wall of the honeycomb guide passage 80.

Figure 5:
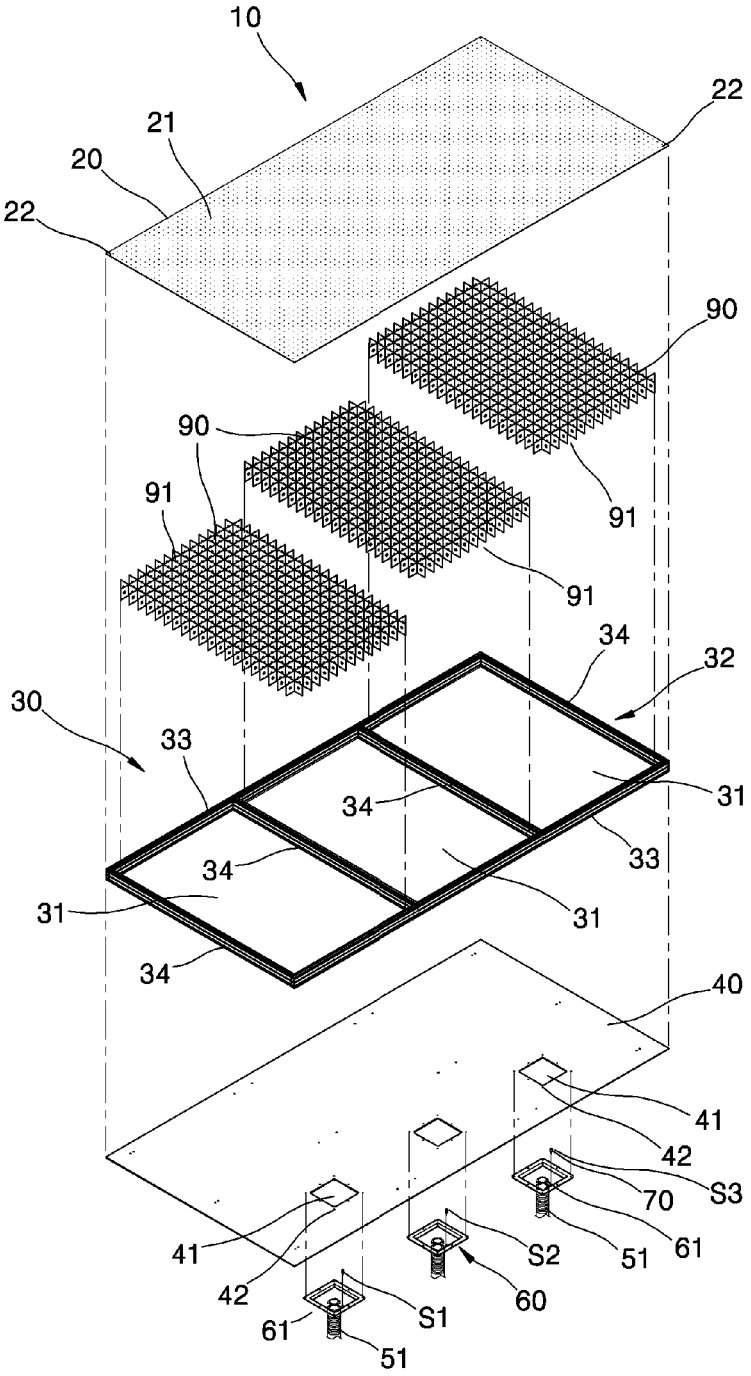
FIG. 5 is a perspective view illustrating an inner construction of a bed of an ink jet printer according to another embodiment of the present invention.
Figure 6:
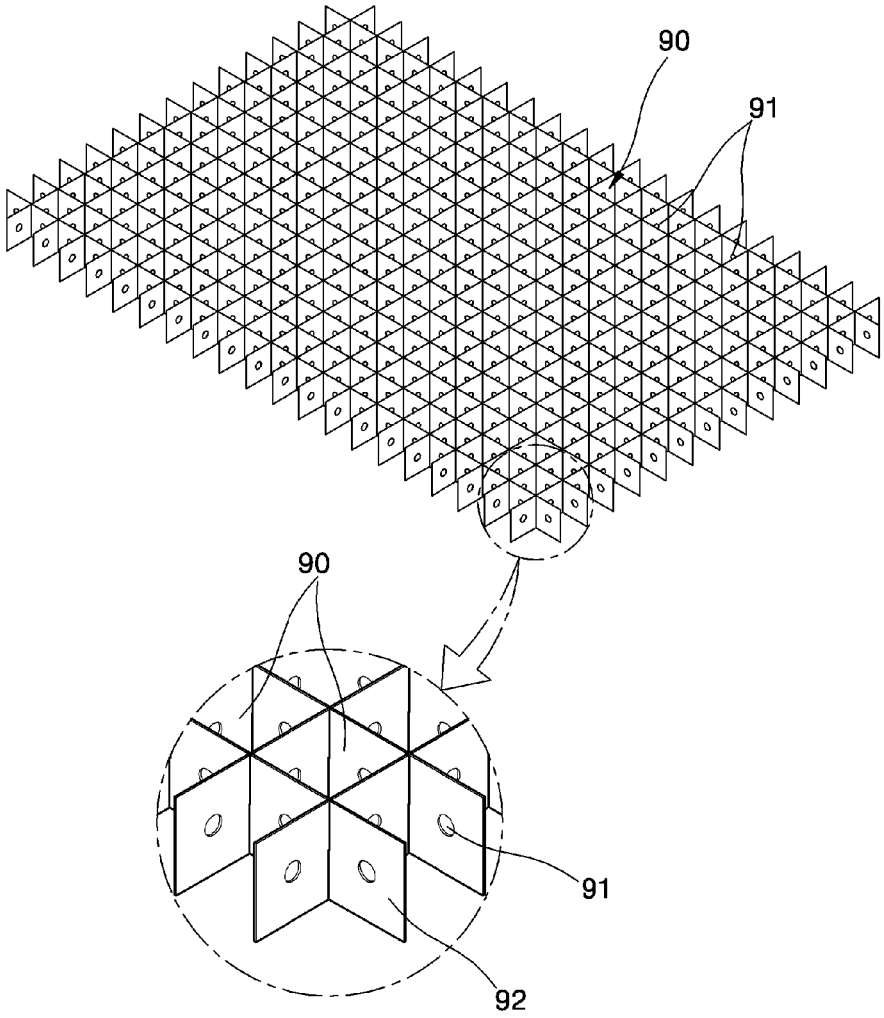
FIG. 6 is an enlarged perspective view of a major part of FIG. 3 illustrating in details the construction of a rectangular guide passage of an intermediate plate according to another embodiment of the present invention.

As shown in FIGS. 5 and 6, the guide passage 90 might be formed in a rectangular shape which repeatedly continuous according to another embodiment of the present invention.

The interconnected connection parts 91 are formed at each guide passage 90.

As shown in FIG. 9, the rectangular guide passage 90 and the connection part 91 all are formed at the partition 92 belonging to the guide passage 90 like the honeycomb guide passage 80. Since the air communicates via the guide passages 90, the vacuum suction force can be uniformly applied.

According to the above construction of the rectangular guide passage 90, the air suction ports 21 are properly arranged in each rectangular guide passage 90.

When the vacuum suction force is applied to the guide space 31 of the interior of the bed 10, the uniform air pressure corresponding to each area is applied to the rectangular guide passage 90, and the air communicates with each guide passage 90 via the connection part 91, so the suction force of each air suction port is uniformly applied, whereby the printing object P placed on the bed 10 can be stably sucked and fixed, not being damaged.

The method of configuring the rectangular guide passage 90 will be described. As it is not shown in the drawings, a paper sheet or a synthetic resin plate having a certain thickness and a width is cut in a vertical direction, and the cut materials are stood upright and are connected with one another in a lattice form and are arranged in a continuous form.

The intermediate plate 30 is additionally provided, which has a guide space 31 formed by a plurality of honeycomb guide passages 80 or a plurality of rectangular guide passages 90 provided between the upper plate 20 and the lower plate 40 of the bed, so the vacuum suction force can be uniformly applied to the entire portions of the bed 10, according to which the best quality printing can be obtained. Even when a heavy printing object P is placed, it can be stably supported by means of the honeycomb guide passages 80 and the rectangular guide passages 90, and the outer sides of the same are supported by means of the support frame 32, so the surface of the bed 10 does not bend, which leads to an excellent structural reliability.

Figure 10:
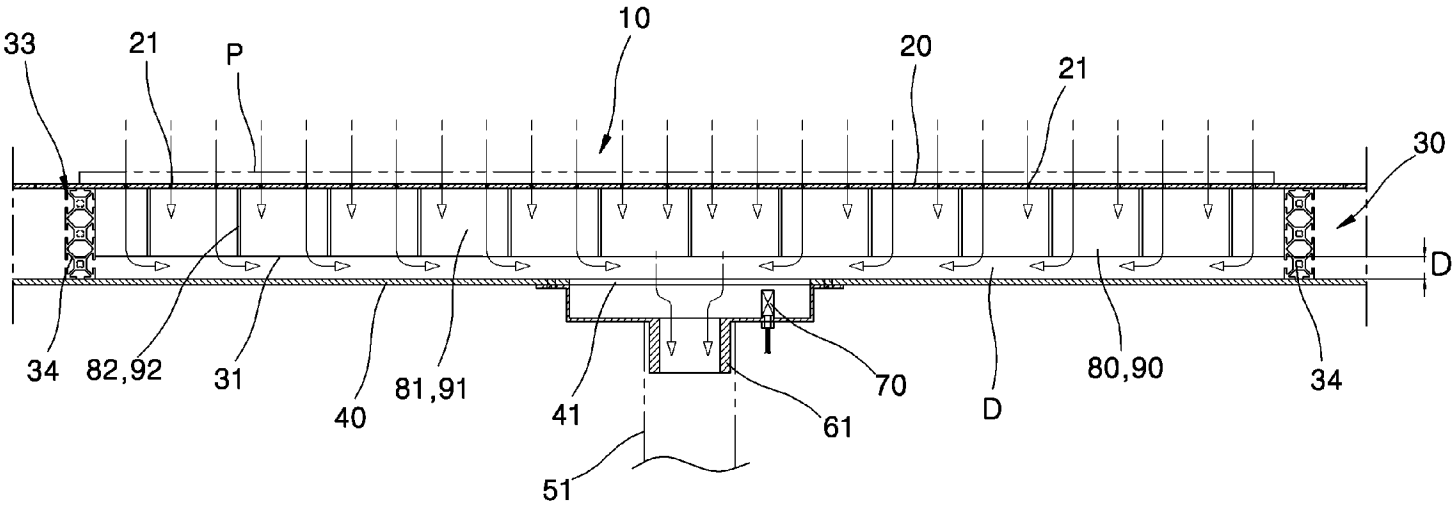
FIG. 10 is an enlarged cross sectional view illustrating the construction of a vacuum adsorption of a bed of an ink jet printer according to the present invention.

In addition, as shown in FIG. 10, according to further another embodiment of the present invention, the lower side of each guide passage of the intermediate plate 30 having the honeycomb guide passage 80 or the rectangular guide passage 90 keeps a certain distance D from the upper side surface of the lower plate 40.

The above construction might function like the connection parts 81 and 91, so the air can communicate via the distance D. When the vacuum suction force is applied to the guide space 31 of the interior of the bed 10, the uniform air pressure corresponding to the area is applied to each guide passage 80, 90, and the air communicates with each guide passage 80, 90 via the distance D. So, the uniform suction force is applied to each air suction port 21, whereby the printing object P placed on the bed 10 is stably sucked and fixed, not being damaged.

The intermediate plate 30 having the distance D might be designed to have another type of connection part in the interior of each guide passage 80, 90 for the same purpose.

According to the bed of the ink jet printer according to the present invention, the vacuum suction force is compared by the sensor installed at the connection part with respect to the weight and dimension of the printing object, so the vacuum suction force of each divided guide space can be automatically adjusted. Here, the guide space might be divided into at least three parts. It is obvious that what the sensor is installed at the connection part is not limited, the installation of which might change depending on the construction of the bed.

The guide passage and the connection part might be formed in various shapes such as a circular shape or a polygonal shape in addition to the disclosed honeycomb shape or rectangular shape.

INDUSTRIAL APPLICABILITY

The present invention is basically directed to printing the best quality printing under the optimum printing environment in such a manner than a printing object is stably placed and fixed at the surface of the bed by automatically controlling the vacuum suction force since the vacuum suction state applied to the interior of the bed is checked depending on the kinds, weight and dimension of the printing object placed on the bed of the printer.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

The invention claimed is:

1. An ink jet printer bed in which a printing object placed on a bed is stably fixed by means of air suction and is printed, comprising:

an upper plate having a plurality of air suction ports on its front surface;

an intermediate plate having at least one guide space, each guide space having an intermediate portion which is open at upper and lower sides thereof, the intermediate plate being assembled to a lower side of the upper plate;

a lower plate assembled to a lower side of the intermediate plate and including at least one air passage associated with each of the guide spaces;

a connection part assembled to each air passage of the lower plate, each connection part being connected with a suction pump; and a sensor configured to detect an air pressure in the interior of the bed and to transmit a result of the detection to a controller configured to control the operation of the suction pump such that the air pressure of the interior of the bed by the suction pump is adjustable, wherein the intermediate plate comprises a plurality of guide passages defined by vertical partitions arranged in a continuous and repeated form in the at least one guide space of the intermediate plate, and wherein a connection part is formed on each partition so that air can flow between said guide passages.

2. The printer bed of claim 1, wherein a support frame is assembled to an outer side of the intermediate plate, and the upper plate and the lower plate are assembled to the upper side and the lower side of the support frame, respectively.

3. The printer bed of claim 1, wherein each of said guide passages is formed in a honeycomb shape.

4. The printer bed of claim 1, wherein each of said guide passages is formed in a rectangular shape the configuration of which is continuously and repeatedly formed.

5. The printer bed of claim 1, wherein a lower side of each guide passage of the intermediate plate is formed at a certain distance from an upper side surface of the lower plate.

6. An ink jet printer which comprises the bed of claim 1.

7. The printer bed of claim 1, wherein the at least one guide space includes at least two guide spaces.

8. The printer bed of claim 7, wherein the controller is configured to stop operation of the suction pump when the air sensor determines an absence of the printing object at at least one of the two guide spaces based on air pressure.

* * * * *